US012085303B2

(12) United States Patent
Kim et al.

(10) Patent No.: US 12,085,303 B2
(45) Date of Patent: Sep. 10, 2024

(54) OUTDOOR UNIT OF AIR CONDITIONER

(71) Applicant: LG ELECTRONICS INC., Seoul (KR)

(72) Inventors: Taejun Kim, Seoul (KR); Seokho Choi, Seoul (KR); Siyoung Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 943 days.

(21) Appl. No.: 17/040,384

(22) PCT Filed: Mar. 21, 2019

(86) PCT No.: PCT/KR2019/003327
§ 371 (c)(1),
(2) Date: Sep. 22, 2020

(87) PCT Pub. No.: WO2019/182387
PCT Pub. Date: Sep. 26, 2019

(65) Prior Publication Data

US 2021/0055017 A1 Feb. 25, 2021

(30) Foreign Application Priority Data

Mar. 22, 2018 (KR) ..... 10-2018-0033373

(51) Int. Cl.
*F24F 13/20* (2006.01)
*F24F 1/16* (2011.01)
(Continued)

(52) U.S. Cl.
CPC ..... *F24F 13/20* (2013.01); *F24F 1/16* (2013.01); *F24F 1/38* (2013.01); *F24F 1/56* (2013.01); *F24F 2013/205* (2013.01)

(58) Field of Classification Search
CPC ..... F24F 13/20; F24F 1/16; F24F 1/38; F24F 1/56; F24F 2013/205
See application file for complete search history.

(56) References Cited

U.S. PATENT DOCUMENTS

2015/0184872 A1 7/2015 Oh et al.
2016/0187005 A1* 6/2016 Kwon ..... F24F 1/40 62/259.1

(Continued)

FOREIGN PATENT DOCUMENTS

CN 1406319 3/2003
CN 1415905 5/2003

(Continued)

OTHER PUBLICATIONS

Chinese Notice of Allowance dated Jul. 20, 2022 issued in Application No. 201980034139.9.

(Continued)

*Primary Examiner* — Gordon A Jones
(74) *Attorney, Agent, or Firm* — KED & ASSOCIATES, LLP

(57) ABSTRACT

The present disclosure relates to an outdoor unit of an air conditioner. The outdoor unit of the air conditioner according to the present disclosure includes: a cabinet including perimeter surfaces disposed vertically in four directions, respectively, and an upper surface disposed on an upper side thereof that is perpendicular to each of the perimeter surfaces, with suction ports and a discharge port, the suction ports being formed in two surfaces that are formed in a first direction and a second direction opposite to each other and one surface that is formed in a third direction perpendicular to the first direction and the second direction, respectively, among the perimeter surfaces, and the discharge port being formed in the upper surface; a heat exchanger disposed (Continued)

inside the cabinet where the suction ports are formed to exchange heat between air introduced into the cabinet and a refrigerant; an air blowing fan disposed inside the cabinet where the discharge port is formed to allow the air that is heat-exchanged by the heat exchanger to flow toward the discharge port; and an orifice disposed along an outer circumference of the air blowing fan, while being spaced apart from the air blowing fan, to form a flow path of the air flowing by the air blowing fan, wherein the orifice includes: a narrowing portion into which the air flowing inside the cabinet is introduced, with the flow path therein having a cross-sectional area that decreases in an air flow direction; a maintaining portion disposed downstream of the narrowing portion, with the flow path therein having a cross-sectional area that is maintained in the air flow direction; and an expanding portion disposed downstream of the maintaining portion, with the flow path therein having a cross-sectional area that increases in the air flow direction, and the maintaining portion has a height that decreases from a fourth direction opposite to the third direction toward the third direction along a circumferential surface of the orifice.

9 Claims, 13 Drawing Sheets

(51) Int. Cl.
*F24F 1/38* (2011.01)
*F24F 1/56* (2011.01)

(56) References Cited

U.S. PATENT DOCUMENTS

| | | | | |
|---|---|---|---|---|
| 2016/0281739 | A1* | 9/2016 | Nakagawa | F04D 29/667 |
| 2017/0167773 | A1* | 6/2017 | Jeon | F24F 1/40 |
| 2019/0010960 | A1* | 1/2019 | Nakashima | F04D 29/547 |
| 2019/0316790 | A1* | 10/2019 | Goto | F24F 1/50 |

FOREIGN PATENT DOCUMENTS

| | | |
|---|---|---|
| CN | 101196315 | 6/2008 |
| CN | 201463118 | 5/2010 |
| CN | 102203430 | 9/2011 |
| CN | 104040186 | 9/2014 |
| CN | 104729041 | 6/2015 |
| CN | 105737274 | 7/2016 |
| CN | 106030120 | 10/2016 |
| CN | 205842861 | 12/2016 |
| EP | 3064780 | 9/2016 |
| JP | 2000-018198 | 1/2000 |
| JP | 2001-003899 | 1/2001 |
| JP | 2001-280296 | 10/2001 |
| JP | 2002-257096 | 9/2002 |
| JP | 2006-077585 | 3/2006 |
| JP | 2007-292443 | 11/2007 |
| JP | 2008-064350 | 3/2008 |
| JP | 2013-221439 | 10/2013 |
| JP | 2016-173210 | 9/2016 |
| JP | 6153029 | 6/2017 |
| KR | 10-2008-0051593 | 6/2008 |
| KR | 10-2015-0075934 | 7/2015 |
| KR | 10-2017-0059936 | 5/2017 |

OTHER PUBLICATIONS

European Search Report issued in Application No. 19771008.0 dated Nov. 19, 2021.
Korean Office Action issued in Application No. 10-2018-0033373 dated Jan. 25, 2022.
Chinese Office Action issued in Application No. 201980034139.9 dated Jul. 21, 2021.
International Search Report (with English Translation) and Written Opinion (with English Translation) dated Jul. 19, 2019 issued in Application No. PCT/KR2019/003327.

* cited by examiner

OUTDOOR UNIT OF AIR CONDITIONER

CROSS-REFERENCE TO RELATED PATENT APPLICATIONS

This application is a U.S. National Stage Application under 35 U.S.C. § 371 of PCT Application No. PCT/KR2019/003327, filed Mar. 21, 2019, which claims priority to Korean Patent Application No. 10-2018-0033373, filed Mar. 22, 2018, whose entire disclosures are hereby incorporated by reference.

BACKGROUND OF THE DISCLOSURE

Field of the Disclosure

The present disclosure relates to an outdoor unit of an air conditioner, and more particularly, to an orifice disposed in the outdoor unit.

Related Art

An air conditioner is a device adjusting an indoor temperature by exchanging heat between a refrigerant and ambient air. The air conditioner may include an indoor unit installed indoors to discharge cooled or heated air and an outdoor unit installed outdoors to exchange heat between the refrigerant and outdoor air.

Each of the indoor and the outdoor unit includes a heat exchanger exchanging heat between the ambient air and the refrigerant, and the heat exchangers are connected to each other through a refrigerant pipe. A compressor is provided for the refrigerant to be transferred along the refrigerant pipe, and the compressor is provided usually in the outdoor unit.

When the compressor is driven to transfer the refrigerant, the compressed refrigerant may be condensed while passing through the heat exchanger provided in the outdoor unit or the heat exchanger provided in the indoor unit. Thereafter, the refrigerant is expanded by an expander and then evaporated while passing through the heat exchanger provided in the indoor unit or the heat exchanger provided in the outdoor unit, and the refrigerant flows back into the compressor to be circulated.

The outdoor unit, in which heat is exchanged by the outdoor heat exchanger between the outdoor air and the refrigerant, includes an air blower allowing the outdoor air to flow for smooth heat exchange between the outdoor air and the refrigerant.

The air blower may include an air blowing fan and an orifice forming a flow path around the air blowing fan. The orifice forming the flow path around the air blowing fan is formed such that air inside a cabinet can be discharged to the outside. Conventionally, the orifice has a structure in which the flow path has a cross section that narrows and expands in an air flow direction, while the cross section of the flow path is symmetric in a front-rear direction and in a left-right direction.

However, the symmetric-type orifice described above has a problem in that when suction ports are not formed in a symmetric structure, power consumption increases or noise is generated due to vortexes.

SUMMARY

The present disclosure provides an outdoor unit of an air conditioner with an improvement in power consumption and noise when suction ports are arranged in an asymmetric relationship.

Particularly, the present disclosure provides an outdoor unit of an air conditioner in which a shape of an orifice is improved to suppress air passing through the orifice from generating vortexes when suction ports are arranged in an asymmetric relationship.

The objects of the present disclosure are not limited to the above-mentioned objects, and other unmentioned objects will be apparent to those skilled in the art from the following descriptions.

According to an exemplary embodiment of the present disclosure, an outdoor unit of an air conditioner includes: a cabinet including perimeter surfaces disposed vertically in four directions, respectively, and an upper surface disposed on an upper side thereof that is perpendicular to each of the perimeter surfaces, with suction ports and a discharge port, the suction ports being formed in two surfaces that are formed in a first direction and a second direction opposite to each other and one surface that is formed in a third direction perpendicular to the first direction and the second direction, respectively, among the perimeter surfaces, and the discharge port being formed in the upper surface; a heat exchanger disposed inside the cabinet where the suction ports are formed to exchange heat between air introduced into the cabinet and a refrigerant; an air blowing fan disposed inside the cabinet where the discharge port is formed to allow the air that is heat-exchanged by the heat exchanger to flow toward the discharge port; and an orifice disposed along an outer circumference of the air blowing fan, while being spaced apart from the air blowing fan, to form a flow path of the air flowing by the air blowing fan. The orifice may include: a narrowing portion into which the air flowing inside the cabinet is introduced, with the flow path therein having a cross-sectional area that decreases in an air flow direction; a maintaining portion disposed downstream of the narrowing portion, with the flow path therein having a cross-sectional area that is maintained in the air flow direction; and an expanding portion disposed downstream of the maintaining portion, with the flow path therein having a cross-sectional area that increases in the air flow direction, and the maintaining portion may have a height that decreases from a fourth direction opposite to the third direction toward the third direction along a circumferential surface of the orifice, so as to increase a length of the flow path defined by the maintaining portion in the fourth direction where no suction part is formed.

An overall height of the orifice defined by the narrowing portion, the maintaining portion and the expanding portion in an up-down direction may be equal in the first, second, third and fourth directions, so that an air blowing module including the orifice is stably mounted in the cabinet.

The narrowing portion of the orifice may have a height that increases from the fourth direction toward the third direction along the circumferential surface of the orifice, such that the overall height of the orifice is maintained equally.

The expanding portion may have an inlet end formed in a circular shape in which a radius from a virtual central axis about which the air blowing fan rotates is equal in all directions, and the expanding portion may have an outlet end formed in an elliptical shape in which a radius from the central axis in the first and second directions is greater than that in the third and fourth directions, so as to expand the flow path in the first and second directions, both of which the air is blown in.

The narrowing portion may have an outlet end formed in a circular shape in which a radius from the virtual central axis about which the air blowing fan rotates is equal in all directions. In the narrowing portion, the radius from the central axis in the first and second directions may increase from the outlet end toward an inlet end thereof, so as to expand the flow path in the first and second directions, both of which the air is blown in.

The expanding portion of the orifice may have a height that is equal in the first, second, third and fourth directions. The height of the expanding portion may be smaller than that of the maintaining portion in the fourth direction, and the height of the expanding portion may be greater than that of the maintaining portion in the third direction.

The narrowing portion may have a height that is 1.5 to 2 times greater than that of the maintaining portion in the fourth direction, and the narrowing portion may have a height that is 6 to 7 times greater than that of the maintaining portion in the third direction, such that the flow path defined by the maintaining portion and the flow path defined by narrowing portion are changed relative to each other.

The height of the maintaining portion in the fourth direction may be 2 to 3 times greater than that in the third direction.

A sum of heights of the expanding portion and the maintaining portion may be greater than one half of a height of the air blowing fan in the fourth direction, so as to make a distance between the fan and the orifice to be short in an area where turbulence occurs, thereby inducing a stable flow of the air.

Details of other embodiments are included in the following description and the accompanying drawings.

Advantageous Effects

The outdoor unit of an air conditioner according to the present disclosure has one or more of the following effects.

First, it is advantageous in that power consumption and noise relative to air flow rate can be reduced by improving a section in which the flow path in the orifice has a cross section that is maintained in consideration of the arrangement of the suction ports. This makes it possible to increases an amount of air discharged with respect to the same power, such that heat can be exchanged in an effective way through the outdoor unit.

Second, the flow path in the orifice may have a maintained cross section in an area where vortexes are generated particularly often by the air blowing fan. This structure is also advantageous in that a gap between the orifice and the air blowing fan can be minimized in the area where the vortexes are generated, thereby improving the performance of the air blowing fan.

The effects of the present disclosure are not limited to the above-mentioned effects, and other unmentioned effects will be apparent to those skilled in the art from the appended claims.

DESCRIPTION OF EXEMPLARY EMBODIMENTS

Figure 1:
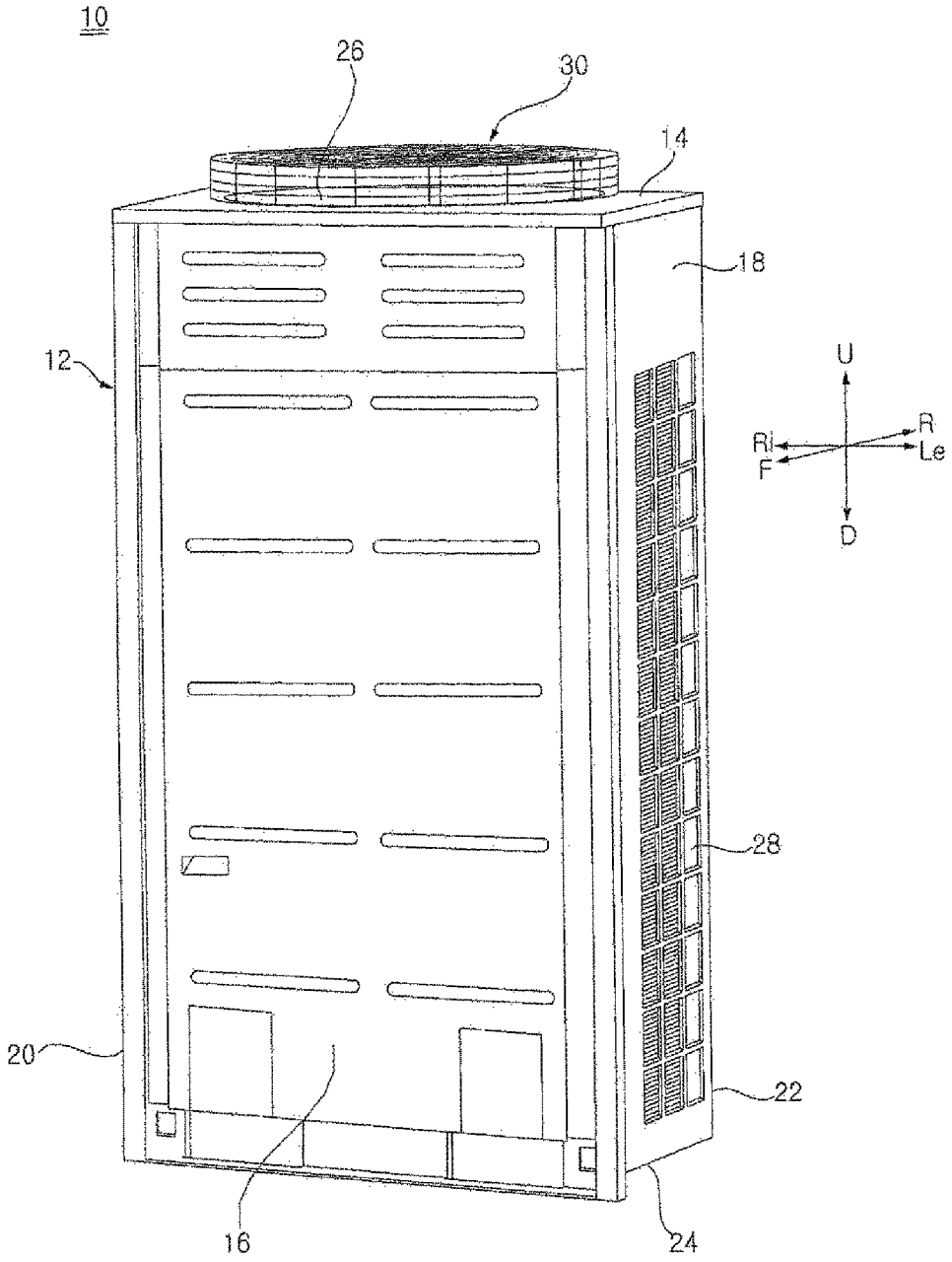
FIG. 1 is a perspective view of an outdoor unit of an air conditioner according to an exemplary embodiment of the present disclosure.

Advantages and features of the present disclosure and methods for achieving them will become apparent from exemplary embodiments that will be described in detail below with reference to the accompanying drawings. However, the present disclosure is not limited to exemplary embodiments disclosed herein but may be implemented in various different ways. The exemplary embodiments are provided for making the present disclosure thorough and for fully conveying the scope of the present disclosure to those skilled in the art. It is to be noted that the scope of the present disclosure is defined only by the claims. Like reference numerals refer to like elements throughout the specification.

Hereinafter, an outdoor unit of an air conditioner according to exemplary embodiments of the present disclosure will be described with reference to the drawings.

Configuration of Outdoor Unit

Figure 2:
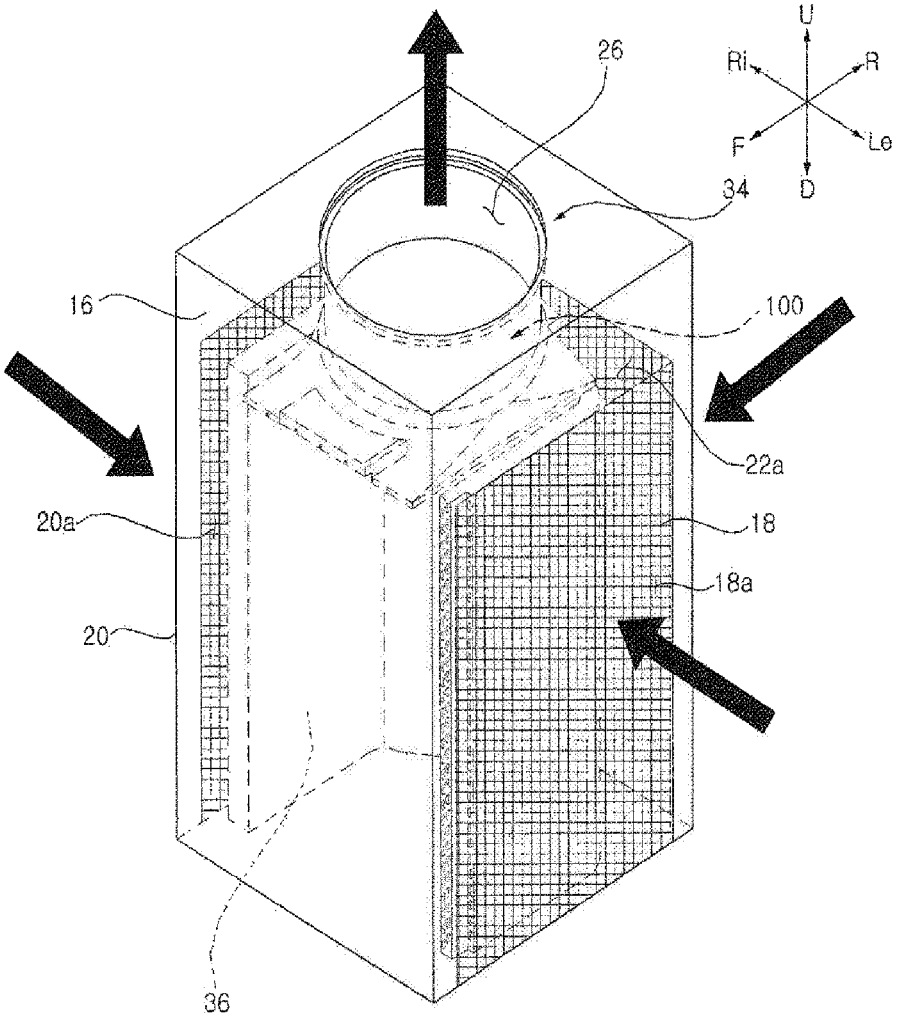
FIG. 2 is a view for explaining an air flow of an outdoor unit according to an exemplary embodiment of the present disclosure.

FIG. 1 is a perspective view of an outdoor unit of an air conditioner according to an exemplary embodiment of the present disclosure. FIG. 2 is a view for explaining an air flow of an outdoor unit according to an exemplary embodiment of the present disclosure.

An outdoor unit 10 of an air conditioner according to the present exemplary embodiment includes a cabinet 12 defining an external appearance, a heat exchanger 32 disposed inside the cabinet 12 to heat-exchange air flowing therein with a refrigerant, an air blowing module 34 discharging the air flowing in the cabinet 12 to the outside.

The cabinet 12 according to the present exemplary embodiment is hollow inside and formed to be elongated vertically in a rectangular parallelepiped shape. The cabinet 12 according to the present exemplary embodiment includes perimeter surfaces in which suction ports are formed, an upper surface 14 disposed on an upper side of the perimeter surfaces with a discharge port 26 formed therein, and a lower surface 24 disposed to face the ground.

The perimeter surfaces according to the present exemplary embodiment include four surfaces. The perimeter surfaces according to the present exemplary embodiment include a front surface 16, a rear surface 22, a left surface 18 and a right surface 20 arranged in front, rear, left and right directions F, R, Le and Ri, respectively, based on FIGS. 1 and 2.

The perimeter surfaces according to the present exemplary embodiment have suction ports 18*a*, 20*a* and 22*a* in two surfaces 18 and 20 that are formed in a first direction Le and in a second direction Ri opposite to each other, respectively, and in one surface 22 that is formed in a third direction R perpendicular to the first direction Le and the second direction Ri. However, no suction port is formed in the surface 16 that is formed in a fourth direction F opposite to the third direction R.

Referring to FIGS. 1 and 2, the first direction and the second direction, in which the suction ports are formed in opposite surfaces among the perimeter surfaces of the cabinet 12 according to the present exemplary embodiment, will be referred to the left and right directions Le and Ri, respectively, the fourth direction, toward which the surface having no suction port formed therein faces, will be referred to as the front direction F, and the third direction, which is opposite to the fourth direction, will be referred to as the rear direction R. It should be understood, however, the first to fourth directions as described above are defined in the drawings for convenience of description in the present disclosure, and the scope of the present disclosure is not limited thereby.

Referring to FIG. 2, in the outdoor unit 10 of the air conditioner according to the present exemplary embodiment, the suction ports 18*a*, 20*a* and 22*a* are formed in the left surface 18, the right surface 20, and the rear surface 22, respectively, excluding the front surface 16, among the perimeter surfaces of the cabinet 12. The suction ports 18*a*, 20*a* and 22*a* according to the present exemplary embodiment are formed in the left surface 18, the right surface 20 and the rear surface 22 of the cabinet 12.

The suction ports 18*a*, 20*a* and 22*a* according to the present exemplary embodiment are disposed to be lower than an orifice 100 disposed inside the cabinet 12. The suction ports 18*a*, 20*a* and 22*a* according to the present exemplary embodiment may be formed outside of the heat exchanger 32 disposed inside the cabinet 12.

The discharge port 26, through which the air flowing inside the cabinet 12 is discharged, is formed in the upper surface 14 according to the present exemplary embodiment. The discharge port 26 according to the present exemplary embodiment may have a generally circular shape. The discharge port 26 according to the present exemplary embodiment may have a shape corresponding to that of an outlet end of the orifice 100, which will be described below. The outdoor unit 10 according to the present exemplary embodiment may include a discharge grill 30 on an upper side of the discharge port 26 formed in the upper surface 14.

The heat exchanger 32 according to the present exemplary embodiment is disposed inward of the suction ports 18*a*, 20*a* and 22*a* formed in the left surface 18, the right surface 20 and the rear surface 22 of the cabinet 12. The heat exchanger 32 according to the present exemplary embodiment may be formed in a "lying U" shape, leading to the left surface 18, the right surface 20, and the rear surface 22.

The heat exchanger 32 according to the present exemplary embodiment may be disposed inward of the suction ports 18*a*, 20*a* and 22*a* to exchange heat between external air introduced through the suction ports 18*a*, 20*a* and 22*a* and the refrigerant.

A compressor (not shown) compressing the refrigerant and an expansion valve (not shown) expanding flowing gas-phase refrigerant may be disposed inside the outdoor unit 10 of the air conditioner according to the present exemplary embodiment. In addition, an oil separator (not shown) recovering oil contained in the refrigerant discharged from the compressor and transferring the recovered oil back to the compressor may be disposed inside the outdoor unit 10 of the air conditioner according to the present exemplary embodiment.

The outdoor unit 10 of the air conditioner according to the present exemplary embodiment may be connected to one or more indoor units (not shown) to adjust an indoor temperature by allowing the refrigerant flow thereinto while condensing, expanding and evaporating the refrigerant compressed through the compressor.

Air Blowing Module and Orifice

Figure 3:
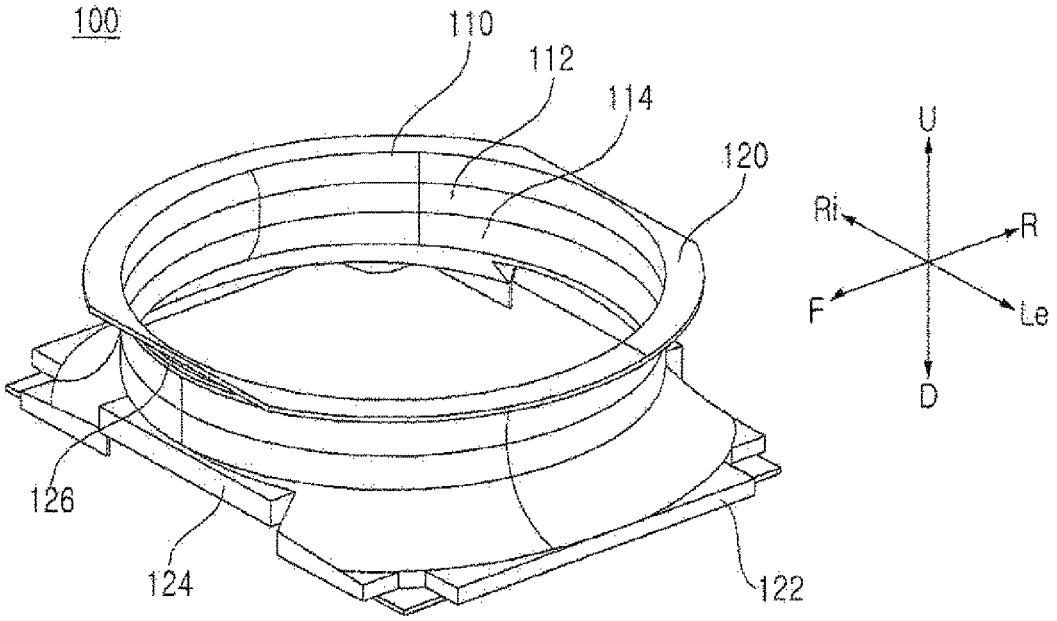
FIG. 3 is a perspective view of an orifice according to an exemplary embodiment of the present disclosure.
Figure 4:
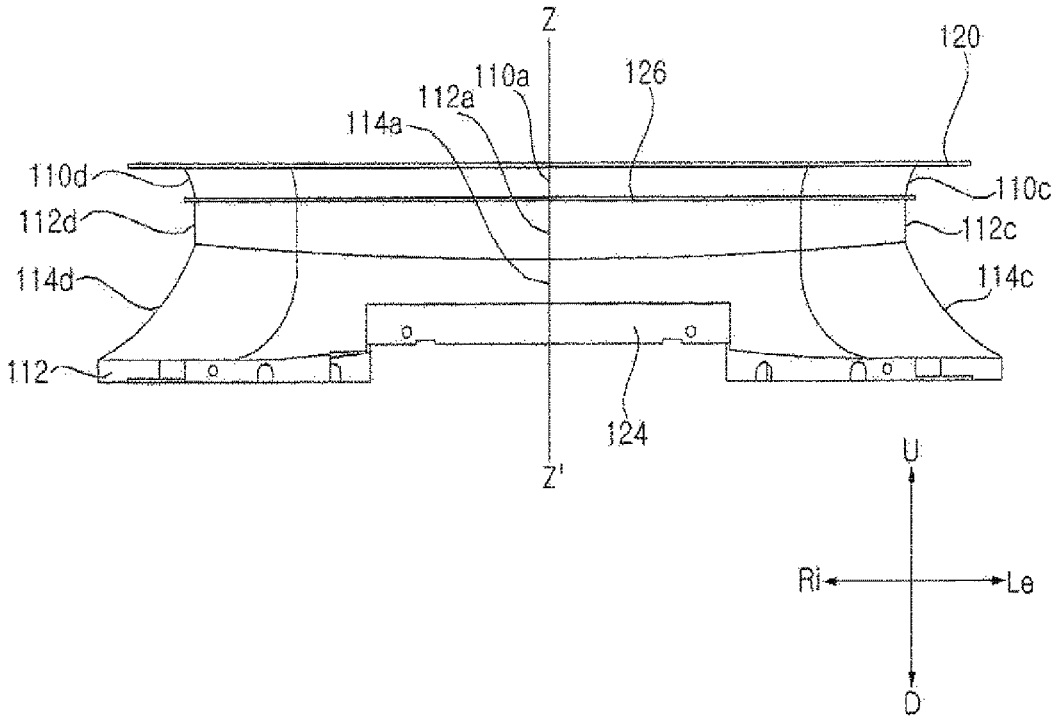
FIG. 4 is a front view of an orifice according to an exemplary embodiment of the present disclosure.
Figure 5:
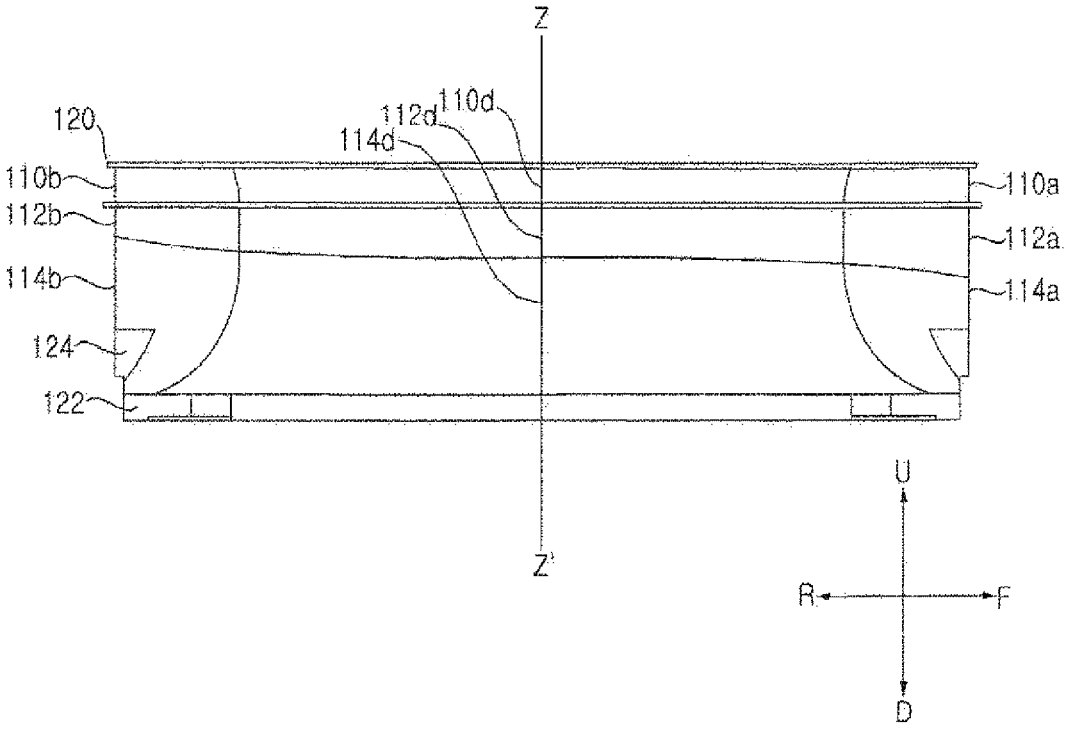
FIG. 5 is a side view of an orifice according to an exemplary embodiment of the present disclosure.
Figure 6:
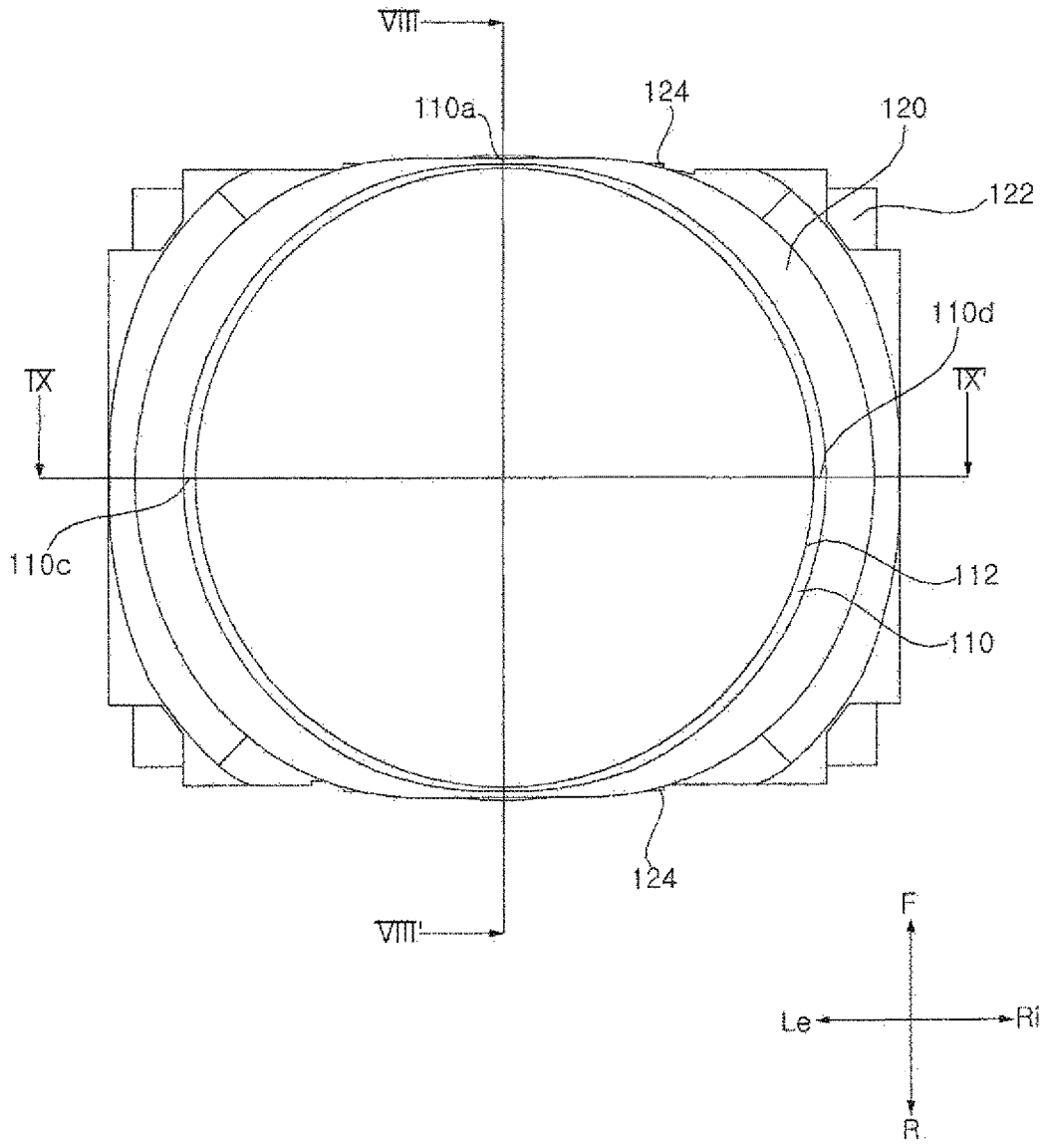
FIG. 6 is a plan view of an orifice according to an exemplary embodiment of the present disclosure.
Figure 7:
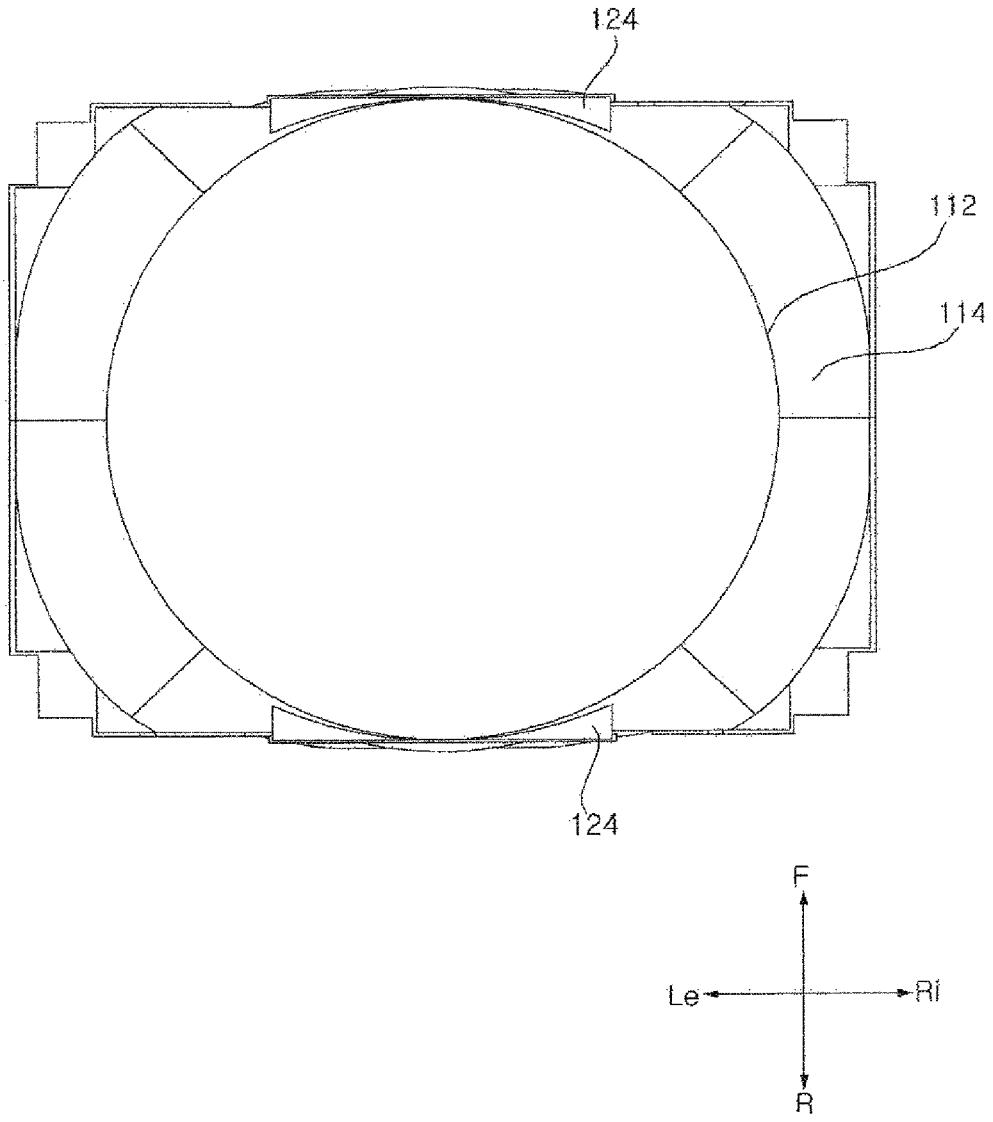
FIG. 7 is a bottom view of an orifice according to an exemplary embodiment of the present disclosure.
Figure 8:
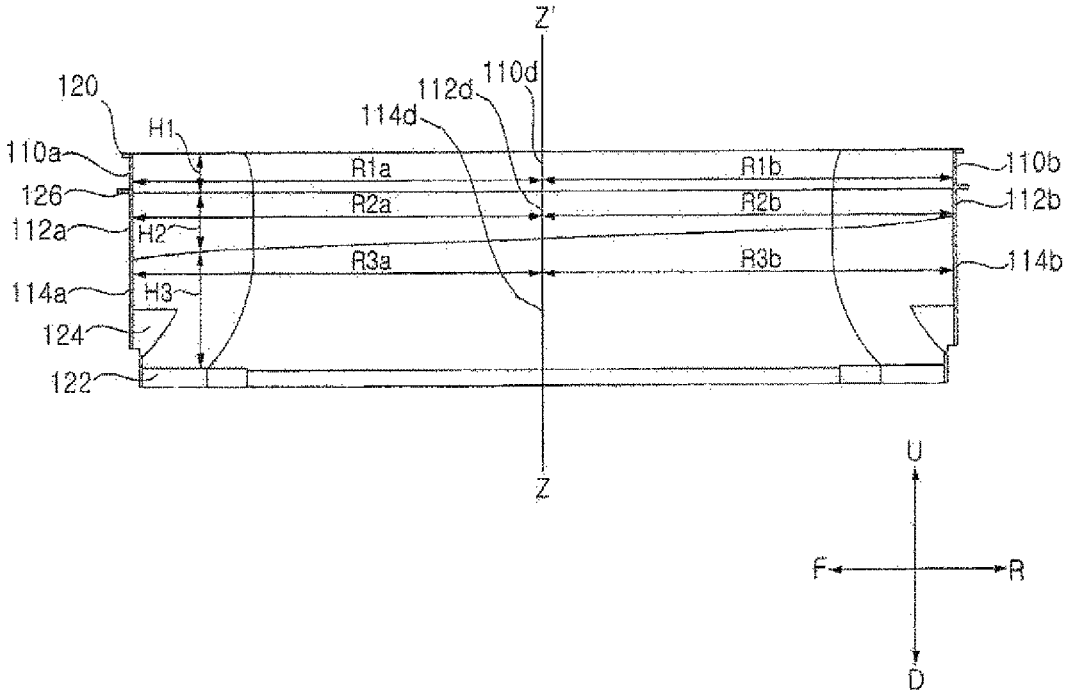
FIG. 8 is a cross-sectional view taken along line VIII-VIII' of FIG. 6.
Figure 9:
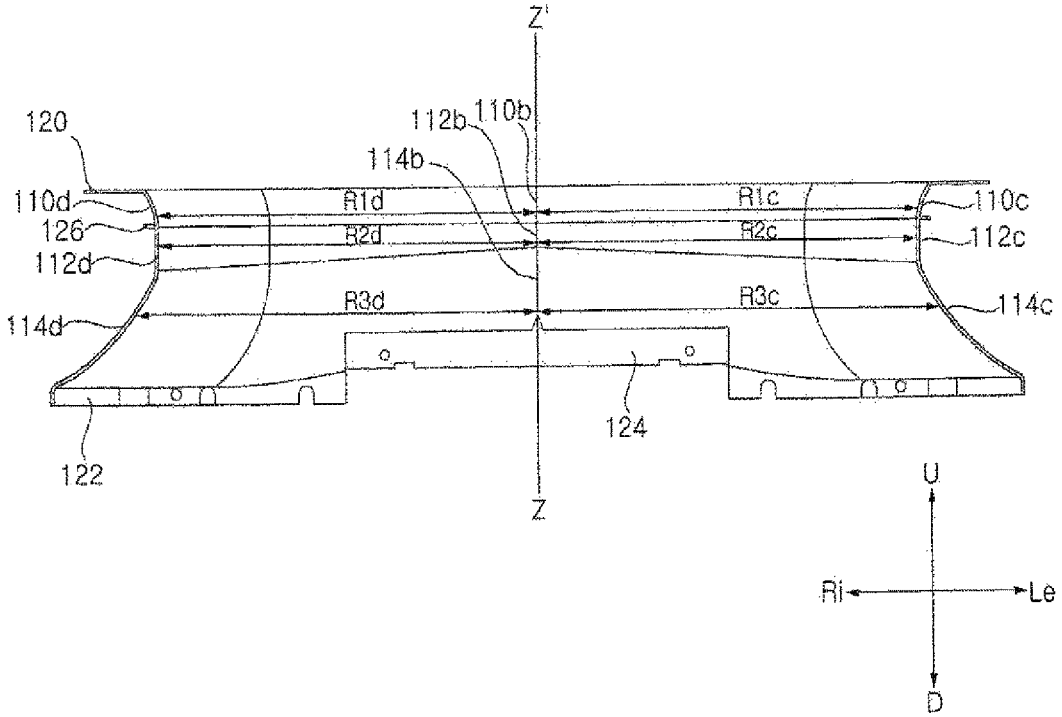
FIG. 9 is a cross-sectional view taken along line IX-IX' of FIG. 6.
Figure 10:
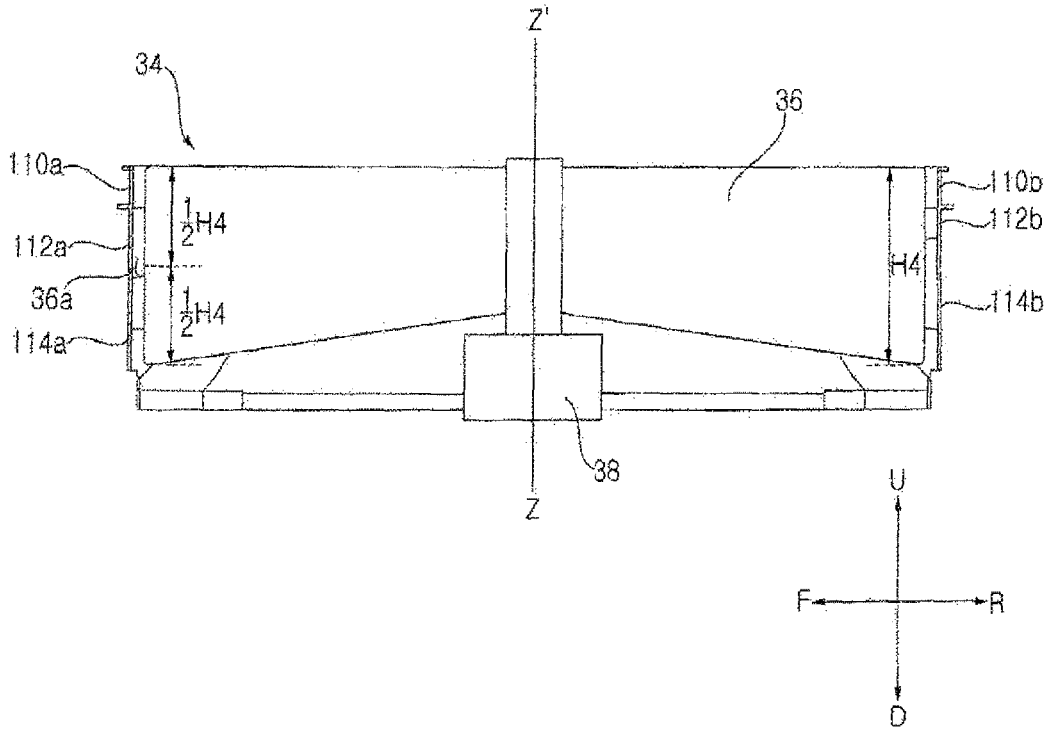
FIG. 10 is a view illustrating an air blowing fan disposed in the orifice of FIG. 8.
Figure 11:
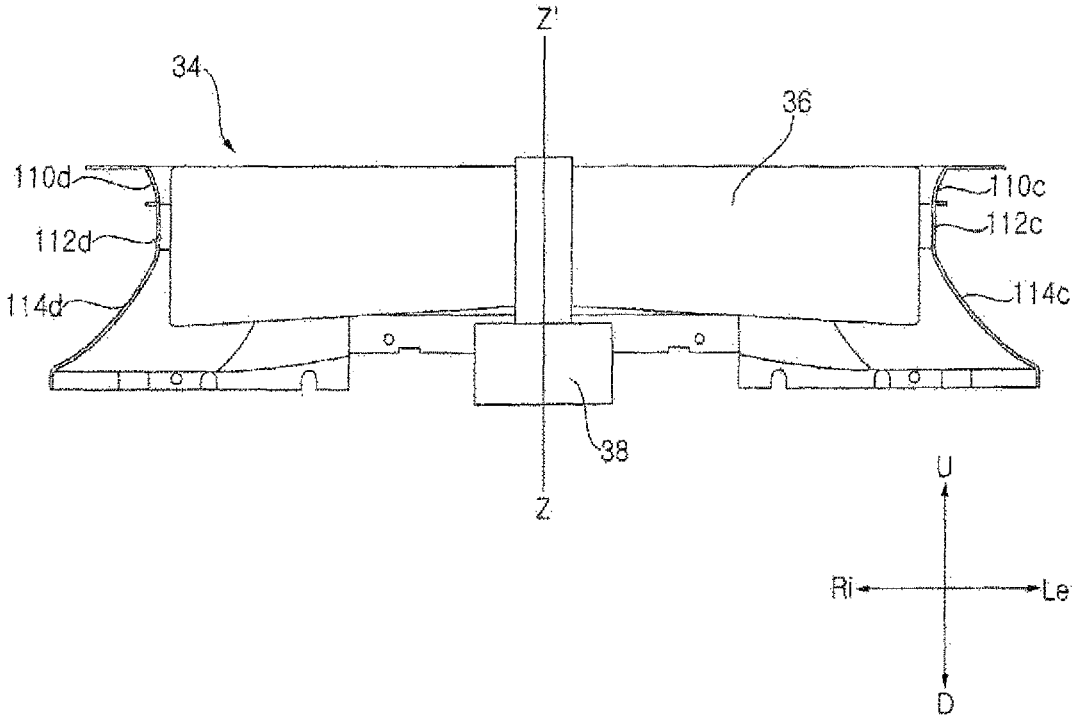
FIG. 11 is a view illustrating an air blowing fan disposed in the orifice of FIG. 9.

FIG. 3 is a perspective view of an orifice according to an exemplary embodiment of the present disclosure. FIG. 4 is a front view of an orifice according to an exemplary embodiment of the present disclosure. FIG. 5 is a side view of an orifice according to an exemplary embodiment of the present disclosure. FIG. 6 is a plan view of an orifice according to an exemplary embodiment of the present disclosure. FIG. 7 is a bottom view of an orifice according to an exemplary embodiment of the present disclosure. FIG. 8 is a cross-sectional view taken along line VIII-VIII' of FIG. 6. FIG. 9 is a cross-sectional view taken along line IX-IX' of FIG. 6. FIG. 10 is a view illustrating an air blowing fan disposed in the orifice of FIG. 8. FIG. 11 is a view illustrating an air blowing fan disposed in the orifice of FIG. 9.

The air blowing module 34 according to the present exemplary embodiment discharges the air inside the cabinet 12 to the outside so that air to be heat-exchanged by the heat exchanger 32 may flow into the cabinet 12. That is, the air blowing module 34 allows external air to flow into the cabinet 12 through the suction ports 18*a*, 20*a* and 22*a* and discharges the air inside the cabinet 12 through the discharge port 26 to the outside of the cabinet 12.

The air blowing module 34 according to the present exemplary embodiment is disposed inside the cabinet 12. The air blowing module 34 according to the present exemplary embodiment is disposed inward of the discharge port 26 formed in the upper surface 14 of the cabinet 12. Referring to FIG. 2, the air blowing module 34 according to the present exemplary embodiment is disposed below the discharge port 26.

The air blowing module 34 according to the present exemplary embodiment may include an air blowing fan 36 rotating for the air inside the cabinet 12 to flow, a motor 38 driving the air blowing fan 36, and an orifice 100 disposed along an outer circumference of the air blowing fan 36 to guide the air discharged out of the cabinet 12.

The air blowing fan 36 according to the present exemplary embodiment is disposed in a space for a flow path formed in the orifice 100. The air blowing fan 36 rotates based on a central axis Z-Z' that is formed vertically. The air blowing fan 36 may rotate through a rotation axis of the motor 38 formed along the central axis Z-Z'. The central axis Z-Z' about which the air blowing fan 36 rotates according to the present exemplary embodiment may be the same as the center of the orifice 100.

The air blowing fan 36 according to the present exemplary embodiment may be an axial fan allowing air that exists below the air blowing fan 36 to flow toward the discharge port 26 formed above the air blowing fan 36. Thus, the air blowing fan 36 may be operated to suck the air inside the cabinet 12 into the flow path in the orifice 100 to discharge the air to the discharge port 26 thereabove.

The motor 38 according to the present exemplary embodiment, which provides a rotational force to the air blowing fan 36, may be disposed below the air blowing fan 36. The motor 38 may be supported by a supporter (not shown) installed inside the cabinet 12.

The orifice 100 according to the present exemplary embodiment guides the air flowing by means of the air blowing fan 36 toward the discharge port 26 formed in the upper surface 14 of the cabinet 12. The orifice according to the present exemplary embodiment may have a generally cylindrical shape, with a circumferential surface thereof formed to be concave inwardly. The orifice 100 according to the present exemplary embodiment guides the air introduced through the suction ports 18*a*, 20*a* and 22*a*, which are formed in the left surface 18, the right surface 20, and the rear surface 22, respectively, excluding the front surface 16, among the perimeter surfaces of the cabinet 12, toward the discharge port 26 formed in the upper surface 14.

The orifice 100 according to the present exemplary embodiment may include: a narrowing portion 114 into which the air flowing inside the cabinet 12 is introduced, with the flow path therein having a cross-sectional area that decreases in an air flow direction; a maintaining portion 112 disposed downstream of the narrowing portion 114, with the flow path therein having a cross-sectional area that is maintained in the air flow direction; and an expanding portion 110 disposed downstream of the maintaining portion 112, with the flow path therein having a cross-sectional area that increases in the air flow direction.

In the orifice 100 according to the present exemplary embodiment, the maintaining portion 112 is formed to have the greatest height in the fourth direction F toward which the surface 16 having no suction port formed therein faces. In the orifice 100 according to the present exemplary embodiment, the maintaining portion 112 is formed to have the smallest height in the third direction R. Here, the height H2 of the maintaining portion 112 may refer to a length of the flow path defined by the maintaining portion 112 in an up-down direction U-D.

In the orifice 100 according to the present exemplary embodiment, the height H2 of the maintaining portion 112 decreases from the fourth direction F toward the third direction R along a circumferential surface of the orifice 100. Referring to FIG. 8, in the orifice 100 according to the present exemplary embodiment, the height H2 of the maintaining portion 112 decreases from a front end 112*a* toward a rear end 112*b*.

Specifically, the height H2 of the maintaining portion 112 may be formed such that the height in the fourth direction is 2 to 3 times greater than that in the third direction. In this case, the height H2 of the maintaining portion 112 in the first and second directions may be an average value of the height of the maintaining portion 112 in the fourth direction and the height of the maintaining portion 112 in the third direction.

In the flow path formed by the orifice 100 according to the present exemplary embodiment, air flows from a lower side D toward an upper side U by means of the air blowing fan 36. Accordingly, the narrowing portion 114, the maintaining portion 112, and the expanding portion 110 are arranged in the orifice 100 according to the present exemplary embodiment, starting from the lower side D.

Referring to FIGS. 8 and 9, in the maintaining portion 112 according to the present exemplary embodiment, radius R2a or R2b in a front-rear direction based on the central axis Z-Z' may be equal to a radius R2c or R2d in a left-right direction based on the central axis Z-Z'. That is, the flow path defined by the maintaining portion 112 according to the present exemplary embodiment may have a cross section in a shape of a concentric circle having the same radius from the central axis Z-Z'.

In the orifice 100 according to the present exemplary embodiment, the narrowing portion 114 has a height H3 that increases from the fourth direction F toward the third direction R along the circumferential surface of the orifice 100. Referring to FIG. 8, in the orifice 100 according to the present exemplary embodiment, the height H3 of the narrowing portion 114 increases from a front end 114*a* toward a rear end 114*b* along the circumferential surface of the orifice 100. Here, the height H3 of the narrowing portion 114 may refer to a length of the flow path defined by the narrowing portion 114 in the up-down direction U-D.

Specifically, the height H3 of the narrowing portion 114 may be 1.5 to 2 times greater than the height H2 of the maintaining portion 112 in the fourth direction. In addition, the height H3 of the narrowing portion 114 may be 6 to 7 times greater than the height H2 of the maintaining portion 112 in the third direction. As the height H2 of the maintaining portion 112 increases from the fourth direction toward the third direction and the height H3 of the narrowing portion 114 decreases from the fourth direction toward the third direction, the height H2 of the maintaining portion 112 and the height H3 of the narrowing portion 114 can be changed in a relatively great ratio.

In the narrowing portion 114 according to the present exemplary embodiment, a radius R3a from the central axis Z-Z' in the fourth direction and a radius R3b from the central axis Z-Z' in the third direction may be equal at an inlet end and an outlet end of the narrowing portion 114.

Here, the inlet end and the outlet end may be set based on the air flow direction. Thus, the inlet end may be a lower end of the narrowing portion 114 through which the air is introduced, and the outlet end may be an upper end of the narrowing portion 114 through which the air is discharged.

Referring to FIG. 8, in the narrowing portion 114 according to the present exemplary embodiment, a distance R3a from the central axis Z-Z' to the front end 114*a* and a distance R3b from the central axis Z-Z' to the rear end 114*b* may be equal at an upper end and a lower end of the narrowing portion 114.

That is, as illustrated in FIG. 8, in the narrowing portion 114 according to the present exemplary embodiment, the flow path may have a cross section in a linear form in the front-rear direction F-R.

In the narrowing portion 114 according to the present exemplary embodiment, the flow path may have a cross section in a curved form in the first and second directions. Referring to FIG. 9, in the narrowing portion 114 according to the present exemplary embodiment, the flow path may have a cross section in a curved form in the left-right direction Le-Ri. Referring to FIG. 9, in the narrowing portion 114 according to the present exemplary embodiment, a distance R3c from the central axis Z-Z' to a left end 114*c* and a distance R3d from the central axis Z-Z' to a right end 114*d* increase from the upper end toward the lower end of the narrowing portion 114.

In the narrowing portion 114 according to the present exemplary embodiment, the flow path may have a cross section that is naturally continued between the first and second directions and the third and fourth directions Le and Ri.

In the orifice 100 according to the present exemplary embodiment, the expanding portion 110 may have a height H1 that is constant from a front end 110*a* to a rear end 110*b*. Here, the height H1 of the expanding portion 110 may refer to a length of the flow path defined by the expanding portion 110 in the up-down direction U-D.

In the expanding portion 110 according to the present exemplary embodiment, a radius R1a from the central axis Z-Z' in the fourth direction and a radius R1b from the central axis Z-Z' in the third direction may be equal at an inlet end and an outlet end of the expanding portion 110. Referring to FIG. 8, in the expanding portion 110 according to the present exemplary embodiment, a distance R1a from the central axis Z-Z' to the front end 110*a* and a distance R1b from the central axis Z-Z' to the rear end 110*b* may be equal at an upper end and a lower end of the expanding portion 110.

In addition, the distance R1a from the central axis Z-Z' to the front end 110*a* or the distance R1b from the central axis Z-Z' to the rear end 110*b* in the expanding portion 110 according to the present exemplary embodiment may be the same as the distance R2a from the central axis Z-Z' to the front end 112*a* or the distance R2b from the central axis Z-Z' to the rear end 112*b* in the maintaining portion 112.

That is, in the expanding portion 110 according to the present exemplary embodiment, the flow path may have a cross section in a linear shape in the front-rear direction F-R.

In the expanding portion 110 according to the present exemplary embodiment, the flow path may have a cross section in a curved form in the first and second directions. Referring to FIG. 9, in the expanding portion 110 according to the present exemplary embodiment, the flow path may have a cross section in a curved form in the left-right direction Le-Ri. Referring to FIG. 9, in the expanding portion 110 according to the present exemplary embodiment, a distance R1c from the central axis Z-Z' to a left end 110*c* and a distance R1d from the central axis Z-Z' to a right end 110*d* increase from the lower end toward the upper end of the expanding portion 110.

Referring to FIG. 6, the outlet end of the expanding portion 110 according to the present exemplary embodiment may be formed in an elliptical shape in which radius lengths from the central axis Z-Z' are different from each other.

An overall height of the flow path in the orifice 100 according to the present exemplary embodiment may be constant from a front end to a rear end. Here, the overall height of the flow path in the orifice 100 may refer to a sum of the respective heights of the narrowing portion 114, the maintaining portion 112 and the expanding portion 110 forming the orifice 100. Therefore, as much as the height H2 of the maintaining portion 112 decreases from the front end 112*a* toward the rear end 112*b*, the height H3 of the narrowing portion 114 increases from the front end 114*a* toward the rear end 114*b*.

In the orifice 100 according to the present exemplary embodiment, the radius of the flow path from the central axis in the third direction and the radius of the flow path from the central axis in the fourth direction may be equal in the maintaining portion 112, the narrowing portion 114 and the expanding portion 110.

On the other hand, in the orifice 100 according to the present exemplary embodiment, the radius of the flow path from the central axis in the first direction and the radius of the flow path from the central axis in the second direction may decrease in the narrowing portion 114 and increase in the expanding portion 110.

The orifice 100 according to the present exemplary embodiment may further include an upper contact portion 120 extending from the upper end of the expanding portion 110 in an outer circumferential direction and contacting the upper surface of the cabinet 12, and a lower fixing portion 122 formed outwardly from the lower end of the narrowing portion 114 and fixing the orifice 100 to the inside of the cabinet 12. In addition, the orifice 100 according to the present exemplary embodiment may further include a supporter connecting portion 124 to which the supporter supporting the motor 38 is fixed.

The orifice 100 according to the present exemplary embodiment may have a rib 126 formed along an outer circumference thereof to reinforce rigidity. The rib 126 according to the present exemplary embodiment may be disposed between the maintaining portion 112 and the expanding portion 110 of the orifice 100.

Relationship with Fan

The air blowing fan 36 according to the present exemplary embodiment is disposed on the flow path formed in the orifice 100. The air blowing fan 36 according to the present exemplary embodiment is disposed between the narrowing portion 114 and the expanding portion 110 of the orifice 100. The air blowing fan 36 according to the present exemplary embodiment is formed to have a height H4 that is smaller than the overall height of the orifice 100. Referring to FIGS. 10 and 11, the height H4 of the air blowing fan 36 may refer to a maximum length from an upper end to a lower end of the air blowing fan 36.

In the orifice 100 according to the present exemplary embodiment, a sum of the heights of the expanding portion 110 and the maintaining portion 112 may be greater than one half of the height of the air blowing fan 36 in the fourth direction. Referring to FIG. 10, the inlet end of the maintaining portion 112 at the front end 112*a* may be disposed lower than a half point 36*a* of the height of the air blowing fan 36.

Since the cabinet 10 according to the present exemplary embodiment has a structure in which the air introduced through the suction port 22*a* in the rear surface 22 flows upwardly because it is blocked by the front surface 16, the orifice 100 may be formed such that the height H2 of the maintaining portion 112 is large at the front end 112*a*. Thus, the maintaining portion 112 may be formed to surround the center portion 36*a* of the height of the air blowing fan 36. This form of the orifice 100 makes it possible to minimize a gap between the air blowing fan 36 and the orifice 100 at a front portion of the air blowing fan 36 where a lot of vortexes are generated, thereby improving the performance of the air blowing fan 36.

A lot of vortexes are generated at the front portion in the fourth direction where no suction port is formed, and in particular, the vortexes are generated often at the center portion of the height of the air blowing fan 36. In the orifice 100 according to the present exemplary embodiment, the maintaining portion 112 may be disposed outside of and at the center portion 36*a* of the height of the air blowing fan 36 in the front direction F, where vortexes are generated particularly often, to minimize a gap between the air blowing fan 36 and the orifice 100.

Air Flow and Effect

Figure 12:
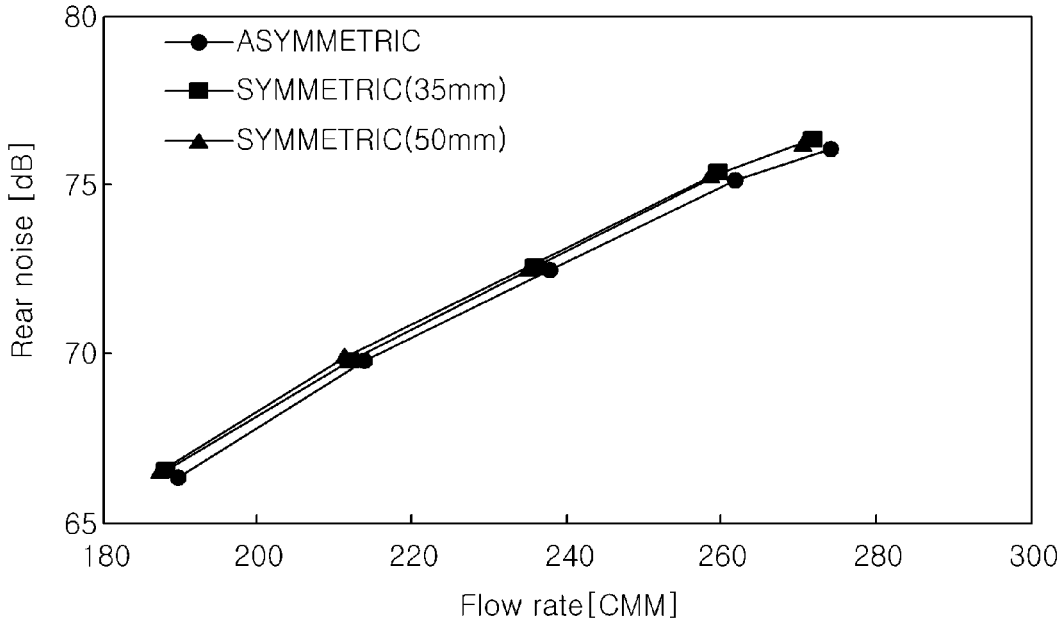
FIG. 12 is a graph comparing an outdoor unit according to an exemplary embodiment of the present disclosure with conventional outdoor units in terms of front noise dB based on air flow rate CMM.
Figure 13:
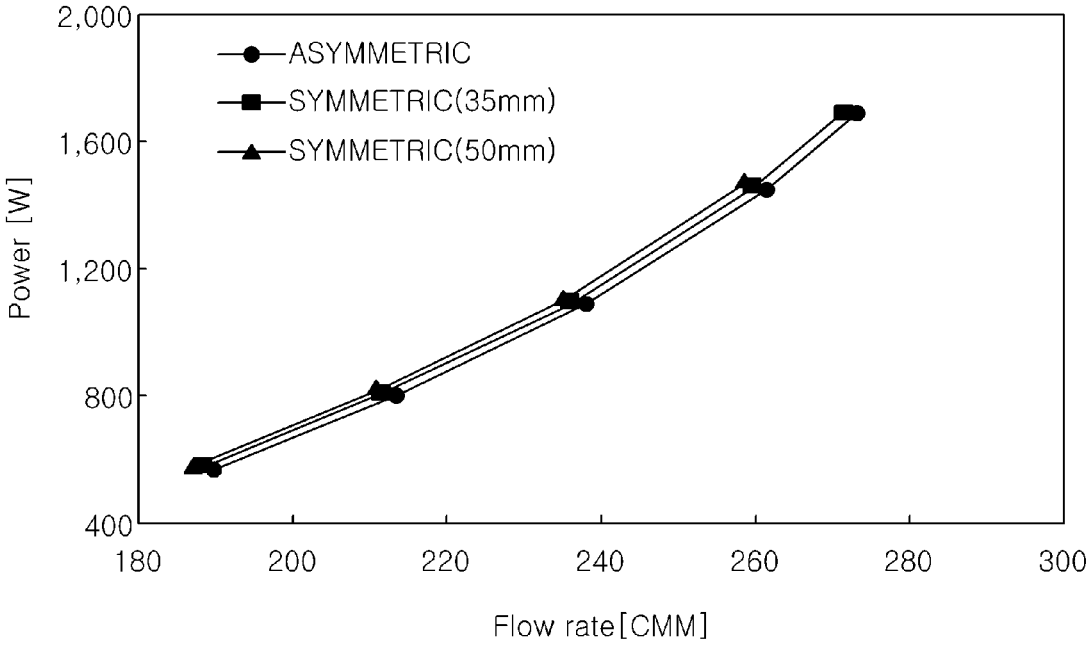
FIG. 13 is a graph comparing an outdoor unit according to an exemplary embodiment of the present disclosure with conventional outdoor units in terms of power consumption W based on air flow rate CMM.

FIG. 12 is a graph comparing an outdoor unit according to an exemplary embodiment of the present disclosure with conventional outdoor units in terms of front noise dB based on air flow rate CMM. FIG. 13 is a graph comparing an outdoor unit according to an exemplary embodiment of the present disclosure with conventional outdoor units in terms of power consumption W based on air flow rate CMM.

In FIGS. 12 and 13, an outdoor unit having an orifice whose maintaining portion is asymmetric according to the present disclosure is compared, in terms of noise and power consumption based on air flow rate, with outdoor units each having an orifice whose maintaining portion is symmetric.

In addition, the outdoor units each having an orifice whose maintaining portion is symmetric are different in the height of the maintaining portion, with one being formed at 35 mm and the other one being formed at 50 mm, to compare the noise and power consumption.

Referring to FIG. 12, it can be seen that the orifice whose maintaining portion is asymmetric according to the present disclosure has a smaller front noise overall than the orifices whose maintaining portion is symmetric.

Referring to FIG. 13, it can also be seen that the orifice whose maintaining portion is asymmetric according to the present disclosure has a smaller power consumption than the orifices whose maintaining portion is symmetric.

It will be apparent that, although the preferred embodiments of the present disclosure have been illustrated and described above, the present disclosure is not limited to the above-described specific embodiments, and various modifications can be made by those skilled in the art without departing from the gist of the present disclosure as claimed in the appended claims. The modifications should not be understood separately from the technical spirit or prospect of the present disclosure.

DESCRIPTION OF REFERENCE NUMERALS

10: outdoor unit
12: cabinet
14: upper surface
16: front surface
18: left surface
20: rear surface
26: discharge port
34: air blowing module
36: air blowing fan
38: motor
100: orifice
110: expanding portion
112: maintaining portion
114: narrowing portion

What is claimed is:

1. An outdoor unit of an air conditioner, the outdoor unit comprising:

a cabinet including perimeter surfaces disposed vertically in four directions, respectively, and an upper surface disposed on an upper side thereof that is perpendicular to each of the perimeter surfaces, with suction ports and a discharge port, the suction ports being formed in two surfaces that are formed in a first direction and a second direction opposite to each other and one surface that is formed in a third direction perpendicular to the first direction and the second direction, respectively, among the perimeter surfaces, and the discharge port being formed in the upper surface;

a heat exchanger disposed inside the cabinet where the suction ports are formed to exchange heat between air introduced into the cabinet and a refrigerant;

an air blowing fan disposed inside the cabinet where the discharge port is formed to allow the air that is heat-exchanged by the heat exchanger to flow toward the discharge port; and an orifice disposed along an outer circumference of the air blowing fan, while being spaced apart from the air blowing fan, to form a flow path of the air flowing by the air blowing fan, wherein the orifice includes:

a narrowing portion into which the air flowing inside the cabinet is introduced, with the flow path therein having a cross-sectional area that decreases in an air flow direction;

a maintaining portion disposed downstream of the narrowing portion, with the flow path therein having a cross-sectional area that is maintained in the air flow direction; and an expanding portion disposed downstream of the maintaining portion, with the flow path therein having a cross-sectional area that increases in the air flow direction, wherein the maintaining portion has a height that decreases from a fourth direction opposite to the third direction toward the third direction along a circumferential surface of the orifice, wherein the narrowing portion of the orifice has a height that increases from the fourth direction toward the third direction along the circumferential surface of the orifice, and wherein an overall height of the orifice defined by the narrowing portion, the maintaining portion and the expanding portion in an up-down direction is equal in the first, second, third and fourth directions.

2. The outdoor unit of claim 1, wherein the expanding portion has an inlet end formed in a circular shape in which a radius from a virtual central axis about which the air blowing fan rotates is equal in all directions, and the expanding portion has an outlet end formed in an elliptical shape in which a radius from the central axis in the first and second directions is greater than that in the third and fourth directions.

3. The outdoor unit of claim 1, wherein the narrowing portion has an outlet end formed in a circular shape in which a radius from a virtual central axis about which the air blowing fan rotates is equal in all directions, and in the narrowing portion, the radius from the central axis in the first and second directions increases from the outlet end toward an inlet end thereof.

4. The outdoor unit of claim 1, wherein a height of the expanding portion of the orifice is uniform in the first, second, third and fourth directions, and the height of the expanding portion is smaller than the height of the maintaining portion in the fourth direction.

5. The outdoor unit of claim 1, wherein a height of the expanding portion of the orifice is uniform in the first, second, third and fourth directions, and the height of the expanding portion is greater than the height of the maintaining portion in the third direction.

6. The outdoor unit of claim 1, wherein the narrowing portion has a height that is 1.5 to 2 times greater than that of the maintaining portion in the fourth direction.

7. The outdoor unit of claim 1, wherein the narrowing portion has a height that is 6 to 7 times greater than the height of the maintaining portion in the third direction.

8. The outdoor unit of claim 1, wherein the height of the maintaining portion in the fourth direction is 2 to 3 times greater than the height of the maintaining portion in the third direction.

9. The outdoor unit of claim 1, wherein a sum of heights of the expanding portion and the maintaining portion is greater than one half of a height of the air blowing fan in the fourth direction.

* * * * *